US006059675A

United States Patent [19]

Finn

[11] Patent Number: 6,059,675

[45] Date of Patent: May 9, 2000

[54] BASEBALL BATTING SYSTEM FOR ABATING ACCIDENTAL RELEASE OF A BAT FROM A PLAYER'S HAND FOLLOWING A SWING

[76] Inventor: Daniel E. Finn, P.O. Box 1471, Tarpon Springs, Fla. 34689-1471

[21] Appl. No.: 08/899,282

[22] Filed: Jul. 23, 1997

[51] Int. Cl.[7] ..... A63B 59/06

[52] U.S. Cl. ..... 473/568; 473/457

[58] Field of Search ..... 473/568, 206, 473/457

[56] References Cited

U.S. PATENT DOCUMENTS

| | | | |
|---|---|---|---|
| 2,780,464 | 2/1957 | Ashley | 473/206 |
| 3,084,938 | 4/1963 | Kapanowski | 473/568 |
| 3,203,697 | 8/1965 | Berzatzy | 473/206 |
| 4,098,503 | 7/1978 | Antone | 473/457 |
| 4,214,751 | 7/1980 | Simpson | 473/457 |

*Primary Examiner*—Mark S. Graham

[57] ABSTRACT

A new and improved baseball batting system for abating accidental release of a bat from a player's hand following a swing is provided. An attachment member includes a ring which has an interior aperture adapted to be located on the gripping area end of a bat adjacent to the knob. The ring has a short radial projection which extends outwardly therefrom and a long axial projection which extends parallel with the axis of the bat as an extension of the short projection remote from the ring. This configuration defines a region between the bat and the short and long projections for the receipt of a batter's hands.

2 Claims, 4 Drawing Sheets

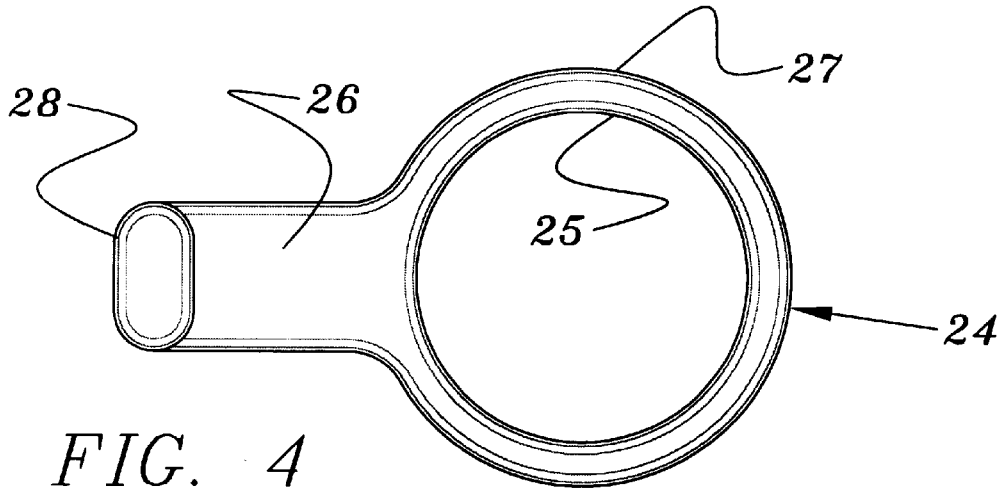
FIG. 4
FIG. 5
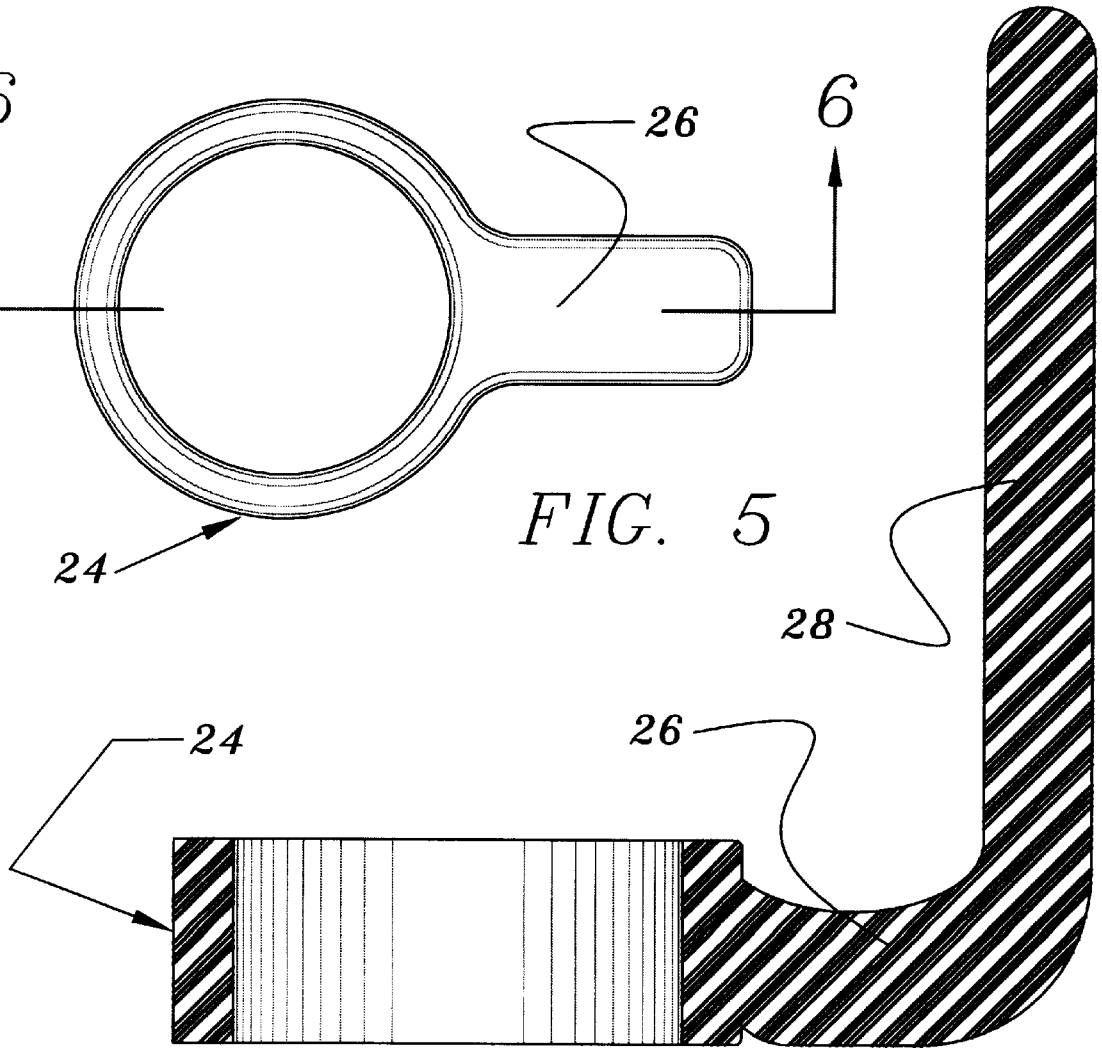
FIG. 6

BASEBALL BATTING SYSTEM FOR ABATING ACCIDENTAL RELEASE OF A BAT FROM A PLAYER'S HAND FOLLOWING A SWING

BACKGROUND OF THE INVENTION

1. Field of the Invention

The present invention relates to a baseball batting system for abating accidental release of a bat from a player's hand following a swing and more particularly pertains to preventing injuries to players and spectators from inadvertently released bats.

2. Description of the Prior Art

The use of baseball bat grip accessories is known in the prior art. More specifically, baseball bat grip accessories heretofore devised and utilized for the purpose of enhancing a user's grip on a bat are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,084,938 to Kapanowski discloses a safety handgrip.

U.S. Pat. No. 5,035,428 to Bartkowicz discloses a rotating grip for a baseball bat.

U.S. Pat. No. 2,984,486 to Jones discloses a slip-proof sleeve for a baseball bat handle.

U.S. Pat. No. 5,524,885 to Heo discloses a terry cloth golf club grip.

While these devices fulfill their respective, particular objective and requirements, the aforementioned patents do not describe a baseball batting system for abating accidental release of a bat from a player's hand following a swing preventing injuries to players and spectators from inadvertently released bats.

In this respect, the baseball batting system for abating accidental release of a bat from a player's hand following a swing according to the present invention substantially departs from the conventional concepts and designs of the prior art, and in doing so provides an apparatus primarily developed for the purpose of preventing injuries to players and spectators from inadvertently released bats.

Therefore, it can be appreciated that there exists a continuing need for a new and improved baseball batting system for abating accidental release of a bat from a player's hand following a swing which can be used for preventing injuries to players and spectators from inadvertently released bats. In this regard, the present invention substantially fulfills this need.

SUMMARY OF THE INVENTION

In the view of the foregoing disadvantages inherent in the known types of baseball bat grip accessories now present in the prior art, the present invention provides an improved baseball batting system for abating accidental release of a bat from a player's hand following a swing. As such, the general purpose of the present invention, which will be described subsequently in greater detail, is to provide a new and improved baseball batting system for abating accidental release of a bat from a player's hand following a swing and method which has all the advantages of the prior art and none of the disadvantages.

To attain this, the present invention essentially comprises a new and improved baseball batting system for abating accidental release of a bat from a player's hand following a swing. In its broadest context, the system consists of a baseball bat and an attachment member. The bat has a far end, a near end and a generally cylindrical hitting area adjacent to the far end. The hitting area has a diameter of between about two and three inches. The bat has a generally cylindrical gripping area adjacent to the near end with a diameter of between about ¾ inch and 1¼ inch. The bat has a tapering transition zone between the far and near ends. The bat also has a knob of a short axial length at the near end. The knob has a diameter between about 1¾ and 2¼ inches. An attachment member is fabricated of a one piece construction from an elastomeric material. The attachment member has a ring with an inner diameter of between about ¾ inch and 1¼ inches and an outer diameter of between about 1 and 1½ inches. The attachment member has a radially extending short planar projection extending outwardly therefrom for a distance of between about 1.5 and 3.0 inches. A long planar projection extends parallel with the axis of the bat as an extension of the end of the short projection remote from the ring. The long projection extends for a distance of between about 3.0 and 4.0 inches. The ring is adapted to be stretched over the knob of the bat and positioned around the gripping area adjacent to the knob. In an operative orientation a user positions his hands around the gripping area of the bat with the ulnar aspect of his lower hand resting against the ring and short projection and the dorsum and fingers of his lower hand resting adjacent the long projection. The long and short projections preclude separation of the bat and attachment member from the batter's lower hand in the event of inadvertent release of the bat by the batter. A first alternate embodiment of the system includes a split positioned in the ring of the attachment member at a location diametrically opposed from the short projection of the ring. A second alternate embodiment of the system includes a split positioned in the ring of the attachment member at a location diametrically opposed from the short projection of the ring and also includes pile type fastening means on the exterior surface of the ring adjacent the split. A strap with pile type fastening means is affixed to the exterior surface of the ring adjacent the split. The pile type fastening means of the strap and ring are couplable to tightly secure the ring around the gripping area of a bat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baseball batting system for abating accidental release of a bat from a player's hand following a swing which has all the advantages of the prior art baseball bat grip accessories and none of the disadvantages.

It is another object of the present invention to provide a new and improved baseball batting system for abating accidental release of a bat from a player's hand following a swing which may be easily and efficiently manufactured and marketed.

It is a further object of the present invention to provide a new and improved baseball batting system for abating accidental release of a bat from a player's hand following a swing which is of durable and reliable construction.

An even further object of the present invention is to provide a new and improved baseball batting system for abating accidental release of a bat from a player's hand following a swing which is susceptible of a low cost of manufacture with regard to both materials and labor, and which accordingly is then susceptible of low prices of sale to the consuming public, thereby making such a baseball batting system for abating accidental release of a bat from a player's hand following a swing economically available to the buying public.

Even still another object of the present invention is to provide a new and improved baseball batting system for abating accidental release of a bat from a player's hand following a swing for preventing injuries to players and spectators from inadvertently released bats.

Lastly, it is an object of the present invention to provide a new and improved baseball batting system for abating accidental release of a bat from a player's hand following a swing. An attachment member is included in the present invention. The attachment member includes a ring which has an interior aperture adapted to be located on the handle end of a bat adjacent to the knob. The ring has a short radial projection which extends outwardly therefrom and a long axial projection which extends parallel with the axis of the bat as an extension of the short projection remote from the ring. This configuration defines a region between the bat and the short and long projections for the receipt of a batter's hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 illustrates a top perspective view of the attachment member.

FIG. 5 illustrates a bottom perspective view of the attachment member.

FIG. 6 is a cross-sectional view of the apparatus taken along section line 6—6 of FIG. 5.

The same reference numerals refer to the same parts through the various Figures.

DESCRIPTION OF THE PREFERRED EMBODIMENT

Figure 1:
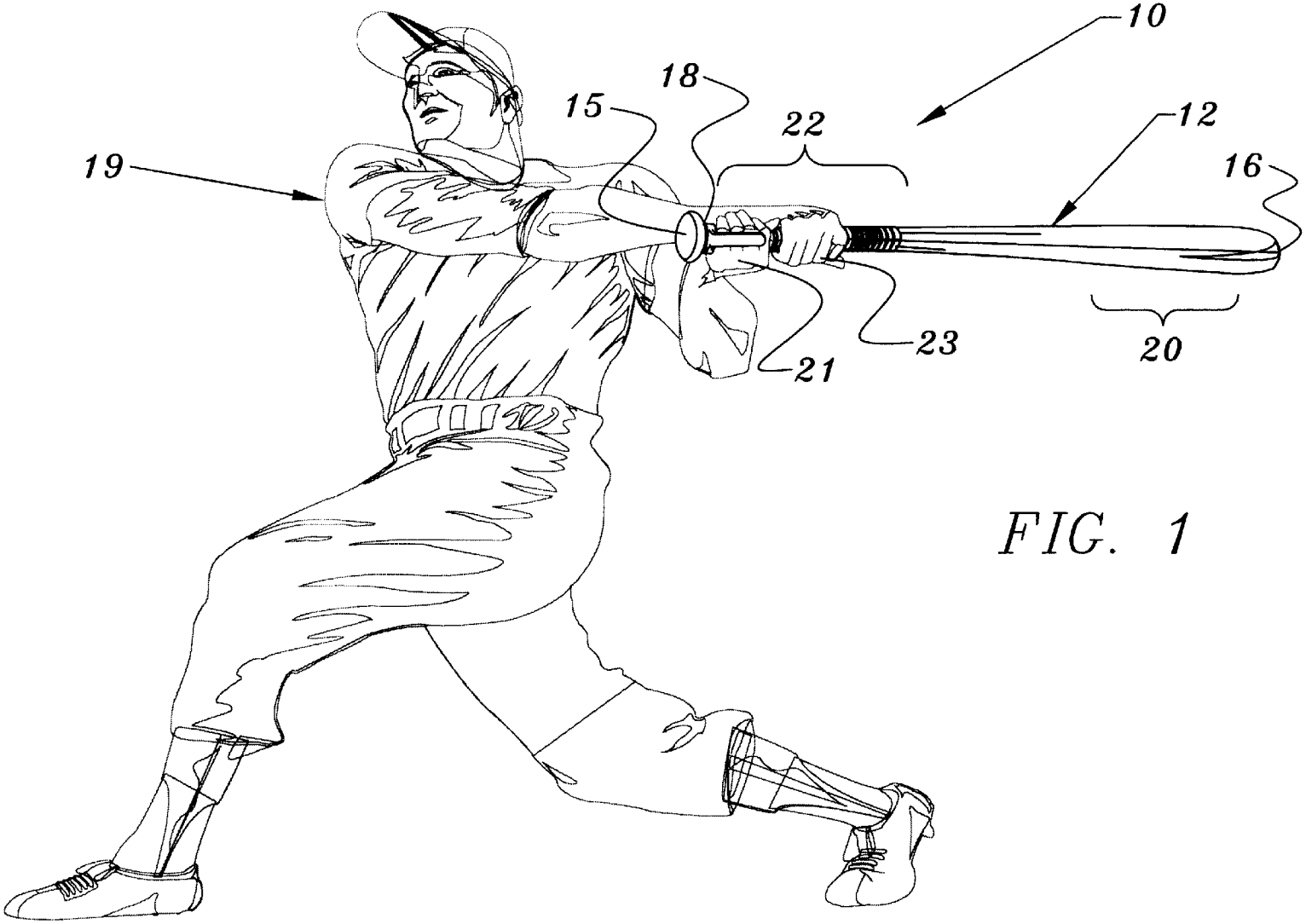
FIG. 1 is a perspective view of the preferred embodiment of the baseball batting system for abating accidental release of a bat from a player's hand following a swing constructed in accordance with the principles of the present invention.

With reference now to the drawings, and in particular, to FIG. 1 thereof, the preferred embodiment of the new and improved baseball batting system for abating accidental release of a bat from a player's hand following a swing embodying the principles and concepts of the present invention and generally designated by the reference number 10 will be described.

Specifically, it will be noted in the various Figures that the device 10 relates to a baseball batting system for abating accidental release of a bat from a player's hand following a swing. In its broadest context, the system 10 consists of a baseball bat 12 and an attachment member 14. Such components are individually configured and correlated with respect to each other so as to attain the desired objective.

Figure 2:
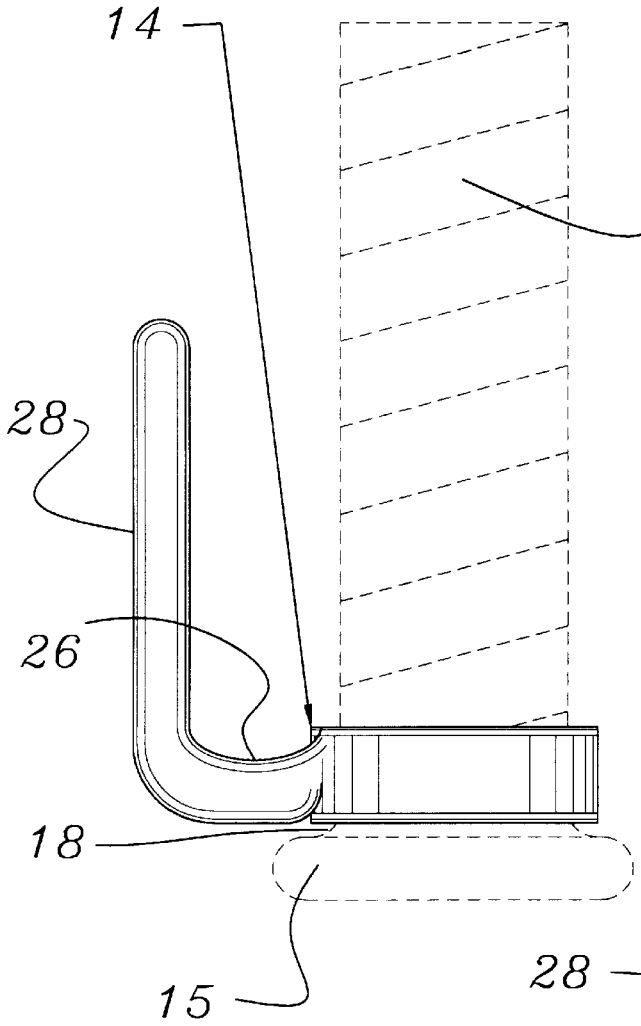
FIG. 2 discloses a side perspective view of the attachment member illustrating the positioning of the short and long projections relative to the gripping area of the baseball bat.
Figure 3:
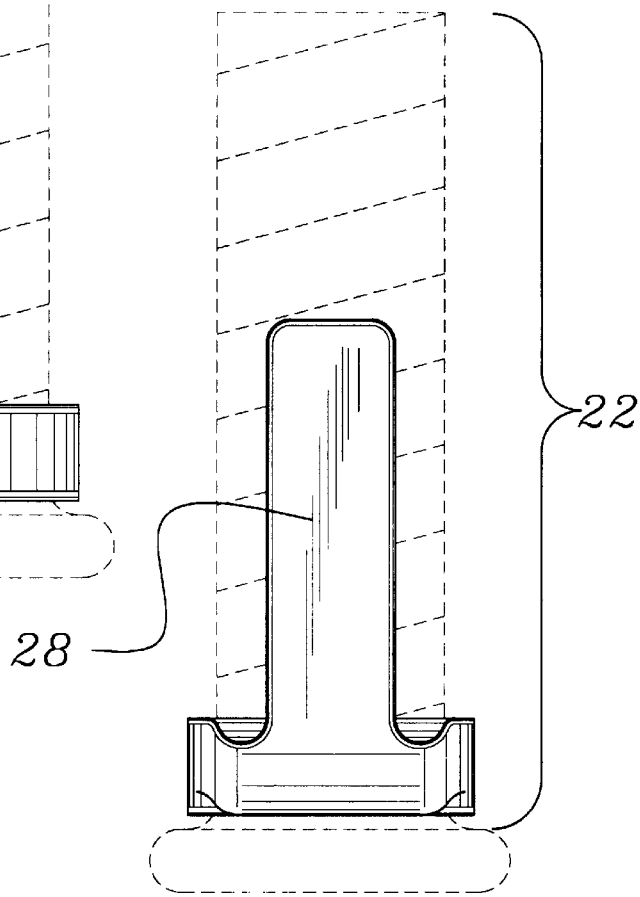
FIG. 3 illustrates a front perspective view of the attachment member.

The bat 12 is fabricated of aluminum in the preferred embodiment. The bat is fabricated of wood in alternate embodiments. The bat has a far end 16, a near end 18 and a generally cylindrical hitting area 20 adjacent to the far end. The hitting area has a diameter of between about two and three inches. The bat has a generally cylindrical gripping area 22 adjacent to the near end. The gripping area is also commonly referred to as the handle of the bat. The diameter of the gripping area is between about ¾ inch and 1¼ inch. The bat has a tapering transition zone between the far and near ends. The bat also has a knob 15 of a short axial length at the near end. The knob has a diameter between about 1¾ and 2¼ inches. In alternate embodiments of the system a bat is not included. In such embodiments the attachment is adapted for use in association with conventional baseball bats. Note FIGS. 1–3.

An attachment member 14 is fabricated of a one piece construction from an elastomeric material. In the preferred embodiment the attachment member is fabricated of semirigid rubber. In alternate embodiments the attachment member is fabricated of semirigid styrofoam, plastic or sponge material. The semirigid construction of the attachment member permits it to serve the function of abating inadvertent release of a bat during a swing while at the same time permitting enough flexibility to prevent injury to a user's hand from excessive twisting. If excessive force is applied to the attachment member it will bend thereby disengaging the bat from the user's hand. In this instance the system will have served it's function of minimizing the distance that the bat will travel after accidental release by the batter. Note FIGS. 2–6.

The attachment member 14 has a ring 24 with an inner diameter of between about ¾ inch and 1¼ inches and an outer diameter of between about 1 and 1½ inches. FIG. 4 illustrates the boundaries of the inner diameter 25 and the outer diameter 27 of the ring. The ring has a diameter of about ¼ inch. The attachment member has a radially extending short planar projection 26 extending outwardly therefrom for a distance of between about 1.5 and 3.0 inches. The short planar projection is shaped in a slightly U-shaped orientation to contour to the shape of the ulnar aspect of a user's hand. Note FIGS. 2 and 6.

A long planar projection 28 extends parallel with the axis of the bat as an extension of the end of the short projection remote from the ring. The long projection extends for a distance of between about 3.0 and 4.0 inches. The width of the long projection is between about ¾ inch and ⅞ inch. In alternate embodiments of the system the short and long projections are fabricated in a cylindrical shape. The ring is adapted to be stretched over the knob of the bat and positioned around the gripping area adjacent to the knob. Alternate embodiments of the system which include modifications to the ring are described below. Note FIGS. 2, 3 and 6.

A baseball player 19 is illustrated in FIG. 1. In an operative orientation a player positions his hands around the gripping area of the bat with his lower hand 21 above the knob and his upper hand 23 above the lower hand. More specifically, the ulnar aspect of the user's lower hand rests against the ring and short projection and the dorsum and fingers of his lower hand rest adjacent the long projection. As previously mentioned, the long and short projections resist separation of the bat and attachment member from the batter's lower hand in the event of inadvertent release of the bat by the batter. Note FIG. 1.

Figure 7:
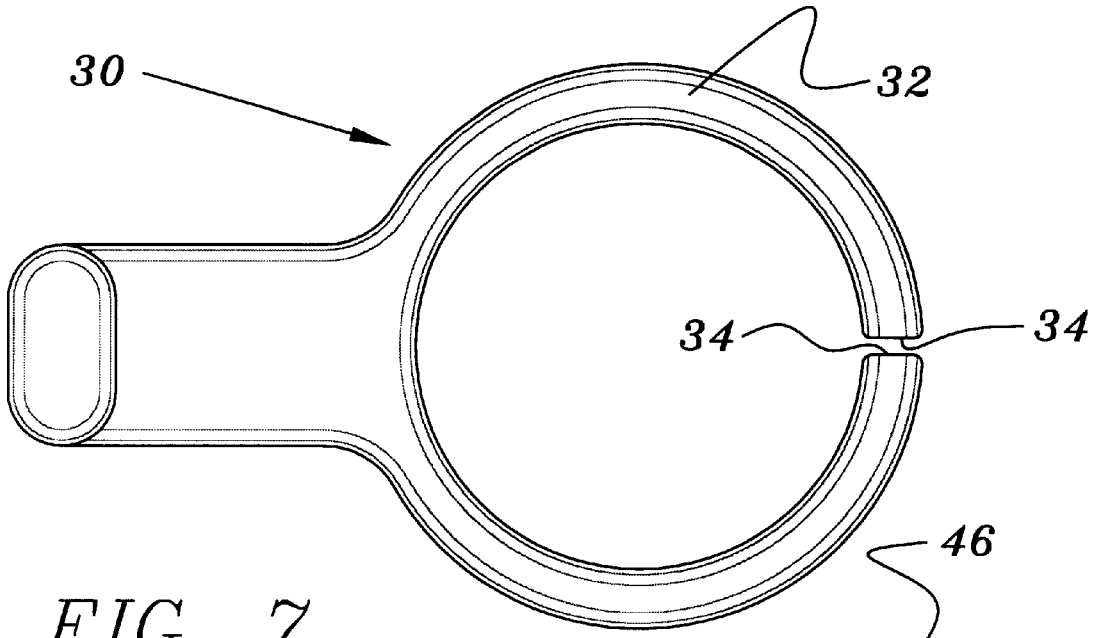
FIG. 7 is top perspective view of a first alternate embodiment of the attachment member illustrating the split.

A first alternate embodiment 30 of the system includes a split 34 positioned in the ring 32 of the attachment member at a location diametrically opposed from the short projection of the ring. This embodiment allows opening of the ring thereby making it easier for a user to position the ring around the gripping area of the bat. Note FIG. 7.

Figure 8:
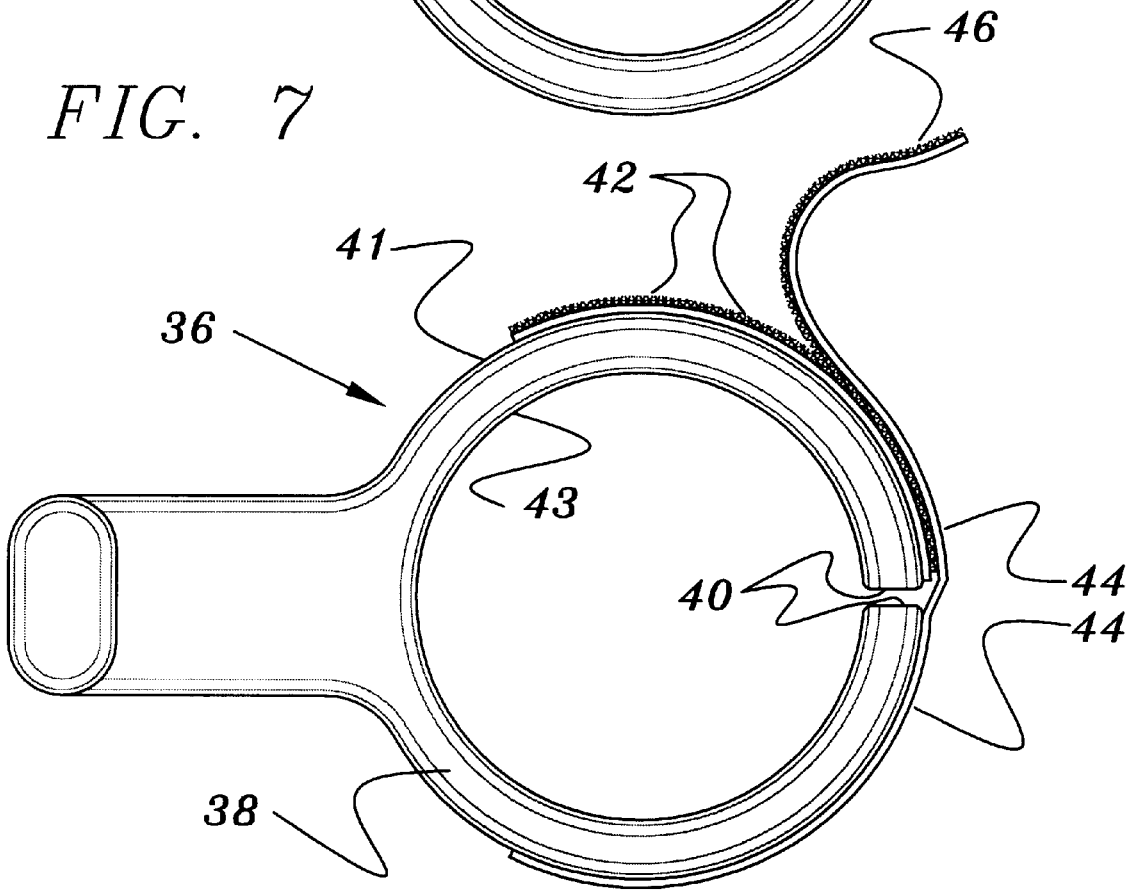
FIG. 8 is top perspective view of a second alternate embodiment of the attachment member illustrating the split, strap and pile fasteners.

A second alternate embodiment 36 of the system includes a split 40 positioned in the ring 38 of the attachment member at a location diametrically opposed from the short projection of the ring. The boundaries of the inner diameter 43 and outer diameter 41 are indicated. This embodiment also includes pile type fastening means on the exterior surface 42 of the ring adjacent the split. A strap 44 with pile type fastening means is affixed to the exterior surface of the ring adjacent the split. The pile type fastening means of the strap 46 and ring 42 are couplable to tightly secure the ring around the gripping area of a bat. This embodiment minimizes sliding of the attachment while also making it easier for a user to position the ring around the gripping area of the bat. Note FIG. 8.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A baseball batting system for abating accidental release of a bat from a player's hand following a swing, comprising, in combination:

a bat having a far end and a near end, the bat having a generally cylindrical hitting area adjacent to the far end, the hitting area having a diameter of between about two and three inches, the bat having a generally cylindrical gripping area adjacent to the near end with a diameter of between about ¾ inch and 1¼ inch, the bat having a tapering transition zone between the far and near ends, the bat also having a knob of a short axial length at the near end, the knob having a diameter between about 1¾ and 2¼ inches; and an attachment member fabricated of a one piece construction from an elastomeric material, the attachment member having a ring with an inner diameter of between about ¾ inch and 1¼ inches and an outer diameter of between about 1 and 1½ inches, the attachment member having a radially extending short planar projection extending outwardly therefrom for a distance of between about 1.5 and 3.0 inches with a long planar projection extending parallel with the axis of the bat as an extension of the end of the short projection remote from the ring, the long projection extending for a distance of between about 3.0 and 4.0 inches, the ring adapted to be stretched over the knob of the bat and positioned around the gripping area adjacent to the knob, in an operative orientation a user positioning his hands around the gripping area of the bat with the ulnar aspect of his lower hand resting against the ring and short projection and the dorsum and fingers of his lower hand resting adjacent the long projection, the long and short projections precluding separation of the bat and attachment member from the batter's lower hand in the event of inadvertent release of the bat by the batter.

2. A baseball batting system for abating accidental release of a bat from a player's hand following a swing, the system being adapted for use in association with a bat having a far end and a near end, the bat having a hitting area adjacent to the far end, the bat having a gripping area adjacent to the near end, the bat also having a knob of a short axial length at the near end, the system comprising, in combination:

an attachment member fabricated of a one piece construction from an elastomeric material, the attachment member having a ring with an inner diameter of between about ¾ inch and 1¼ inches and an outer diameter of between about 1 and 1½ inches, the attachment member having a radially extending short planar projection extending outwardly therefrom for a distance of between about 1.5 and 3.0 inches with a long planar projection extending parallel with the axis of the bat as an extension of the end of the short projection remote from the ring, the long projection extending for a distance of between about 3.0 and 4.0 inches, the ring adapted to be stretched over the knob of the bat and positioned around the gripping area adjacent to the knob, in an operative orientation a user positioning his hands around the gripping area of the bat with the ulnar aspect of his lower hand resting against the ring and short projection and the dorsum and fingers of his lower hand resting adjacent the long projection, the long and short projections precluding separation of the bat and attachment member from the batter's lower hand in the event of inadvertent release of the bat by the batter.

* * * * *